US010450766B2

(12) United States Patent
Khamis et al.

(10) Patent No.: US 10,450,766 B2
(45) Date of Patent: Oct. 22, 2019

(54) TANNING LEDGE SUPPORT STRUCTURE

(71) Applicant: Thursday Pools, Fortville, IN (US)

(72) Inventors: William Khamis, Fortville, IN (US); Edward Vondell, Fishers, IN (US); David Camp, Wilkinson, IN (US); Christopher Taylor, Anderson, IN (US)

(73) Assignee: Thursday Pools, Fortville, IN (US)

( * ) Notice: Subject to any disclaimer, the term of this patent is extended or adjusted under 35 U.S.C. 154(b) by 52 days.

(21) Appl. No.: 15/801,771

(22) Filed: Nov. 2, 2017

(65) Prior Publication Data

US 2019/0128003 A1 May 2, 2019

(51) Int. Cl.
*E04H 4/14* (2006.01)
*E02D 27/32* (2006.01)

(52) U.S. Cl.
CPC ..... *E04H 4/14* (2013.01); *E02D 27/32* (2013.01); *E04H 4/144* (2013.01); *E02D 2300/007* (2013.01); *E02D 2300/0035* (2013.01)

(58) Field of Classification Search
CPC ..... E04H 4/14; E04H 4/144; E02D 27/32; E02D 27/38; E02D 27/50; E02D 2300/0035; E02D 2300/007
USPC ..... 52/169.7, 169.8, 169.1, 169.5; 4/513, 4/506
See application file for complete search history.

(56) References Cited

U.S. PATENT DOCUMENTS 4,599,835 A * 7/1986 Rinke ..... E04H 4/144 52/169.7
2007/0039091 A1* 2/2007 Foy ..... A47K 3/006 4/488
2008/0120928 A1* 5/2008 St-Pierre ..... E04H 4/144 52/184

* cited by examiner

*Primary Examiner* — Janie M Loeppke
(74) *Attorney, Agent, or Firm* — C. John Brannon; Brannon Sowers & Cracraft PC

(57) ABSTRACT

A swimming pool assembly, including a swimming pool body defining a pool top edge and an oppositely disposed bottom pool floor member connected by at least one pool wall and having a shallow deck portion and a support structure for providing support to the deck portion operationally connected to the deck portion and extending away from the pool top edge. The support structure further includes a support structure floor member, at least one support structure wall member extending therefrom and connected to the shallow deck portion to define an enclosure, and at least one fluid access aperture formed through the support structure wall member to provide fluidic communication with the enclosure.

10 Claims, 7 Drawing Sheets

TANNING LEDGE SUPPORT STRUCTURE

TECHNICAL FIELD

The present novel technology relates generally to the field of excavation, and, more particularly, to a method and apparatus for the stabilization and support of in-ground fiberglass pool bodies having preformed tanning ledges.

BACKGROUND

Preformed fiberglass swimming pools offer many advantages over vinyl liner and in-situ formed shotcrete or concrete walled swimming pools. Fiberglass pool bodies may be quickly and inexpensively formed and require considerably less effort to put into the ground. Recently, there has been increased interest in fiberglass pool bodies having a preformed shallow flat portion, or tanning ledge or deck, upon which swimmers may lay for sun-tanning purposes. Upon installation, the tanning ledge effectively becomes an overhang extending away from the main pool body, defining a crawlspace that must be backfilled to provide support for the tanning ledge. The backfill material is typically gravel, and backfilling is typically performed by one or more workmen crammed into the crawlspace to manually direct and distribute the gravel. Gravel backfill is preferred as it is less prone to flowing and settling, but is harder to evenly distribute under the tanning ledge and requires manual distribution by workmen. Backfilling with concrete removes the need for a workman, but is very costly. Further, backfilling the space with any material, such as gravel, sand, concrete or the like typically leaves a significant top void which results in the tanning ledge being unsupported, especially after the pool seasons and settles, leading to flexure and sagging of the tanning ledge.

Thus, there remains a need for a method and apparatus that would allow easy installation of the pool body with proper support of the tanning ledge. The present novel technology addresses this need.

SUMMARY

The present novel technology relates to a method and apparatus for providing a support and reinforcement system for a tanning ledged fiberglass swimming pool. One object of the present novel technology is to provide an improved fiberglass swimming pool system. Related objects and advantages of the present novel technology will be apparent from the following description.

DETAILED DESCRIPTION OF THE PREFERRED EMBODIMENT

Figure 1:
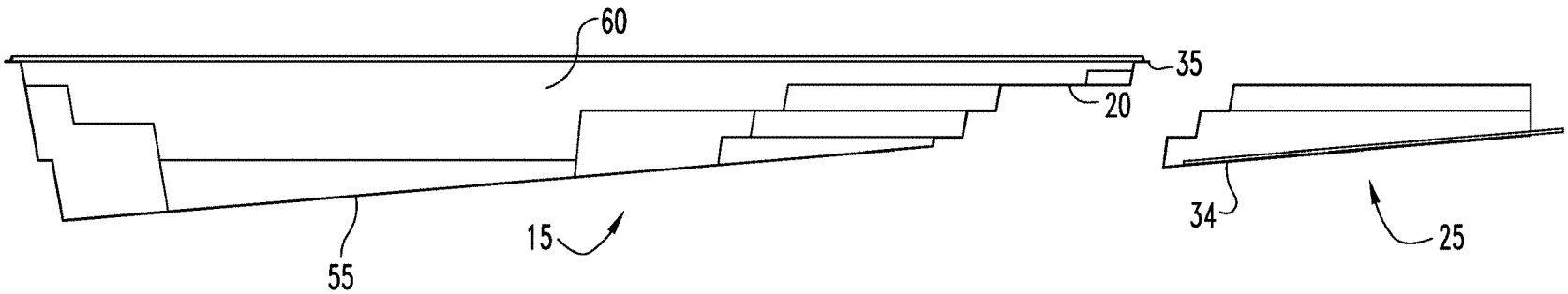
FIG. 1 is a side elevation view of a first embodiment fiberglass pool assembly of the present novel technology.
Figure 2:
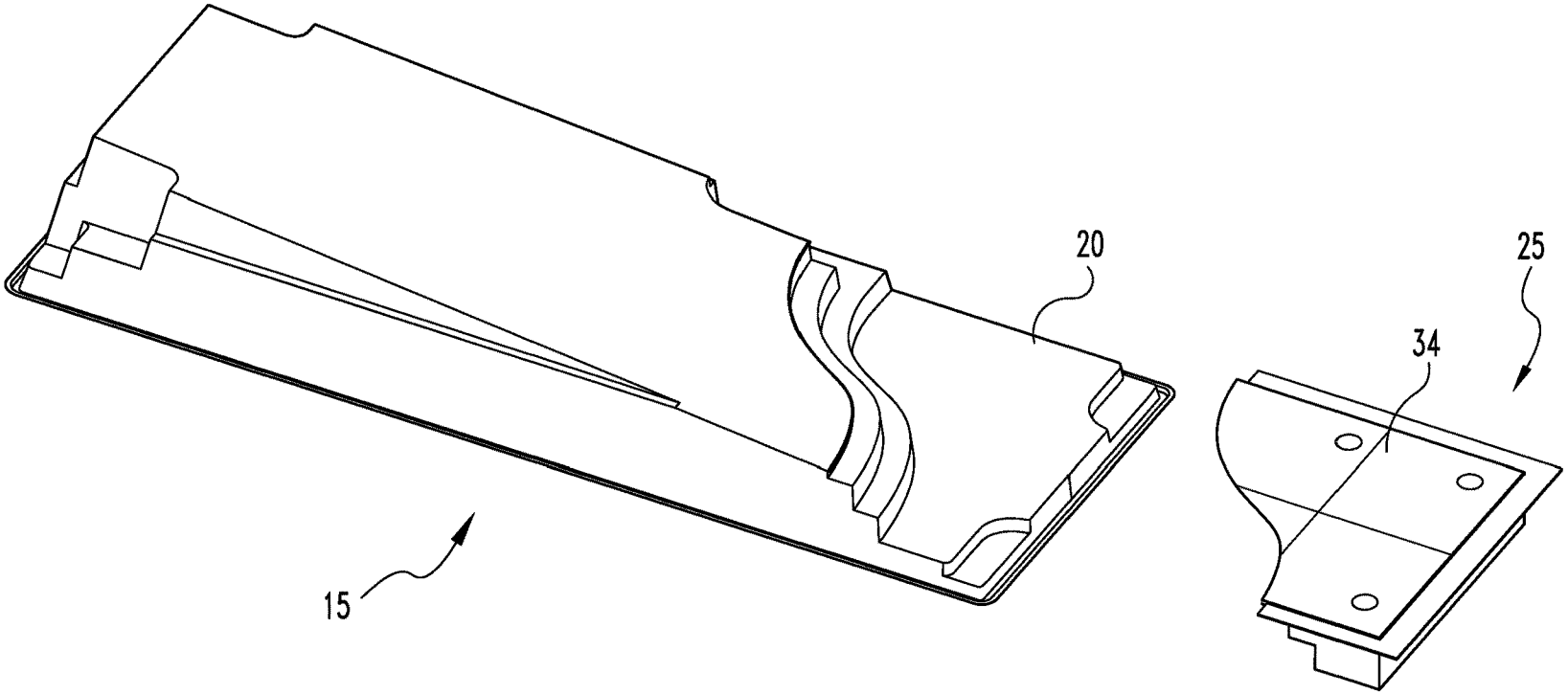
FIG. 2 is a bottom perspective view of the pool assembly of FIG. 1.
Figure 3:
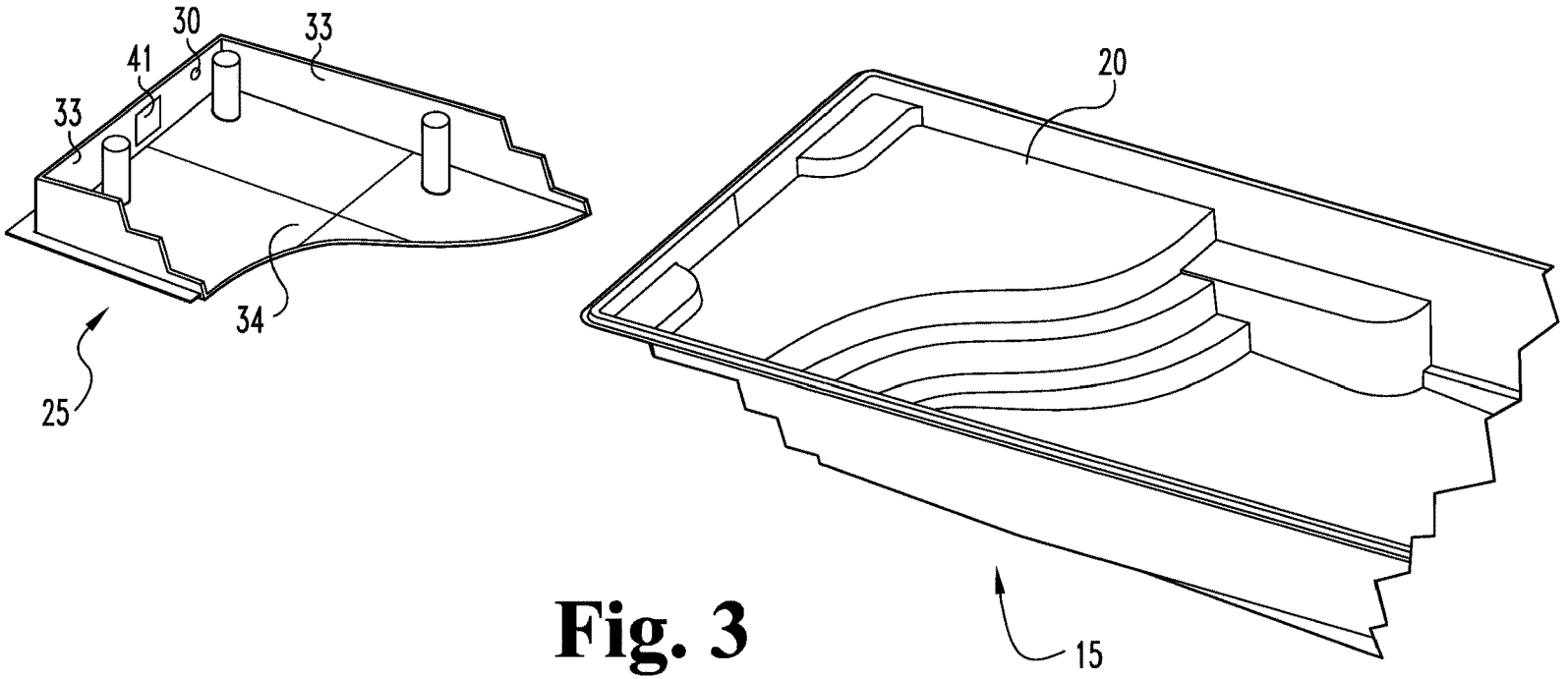
FIG. 3 is a top perspective partial cutaway view of the curtain of FIG. 1.
Figure 4:
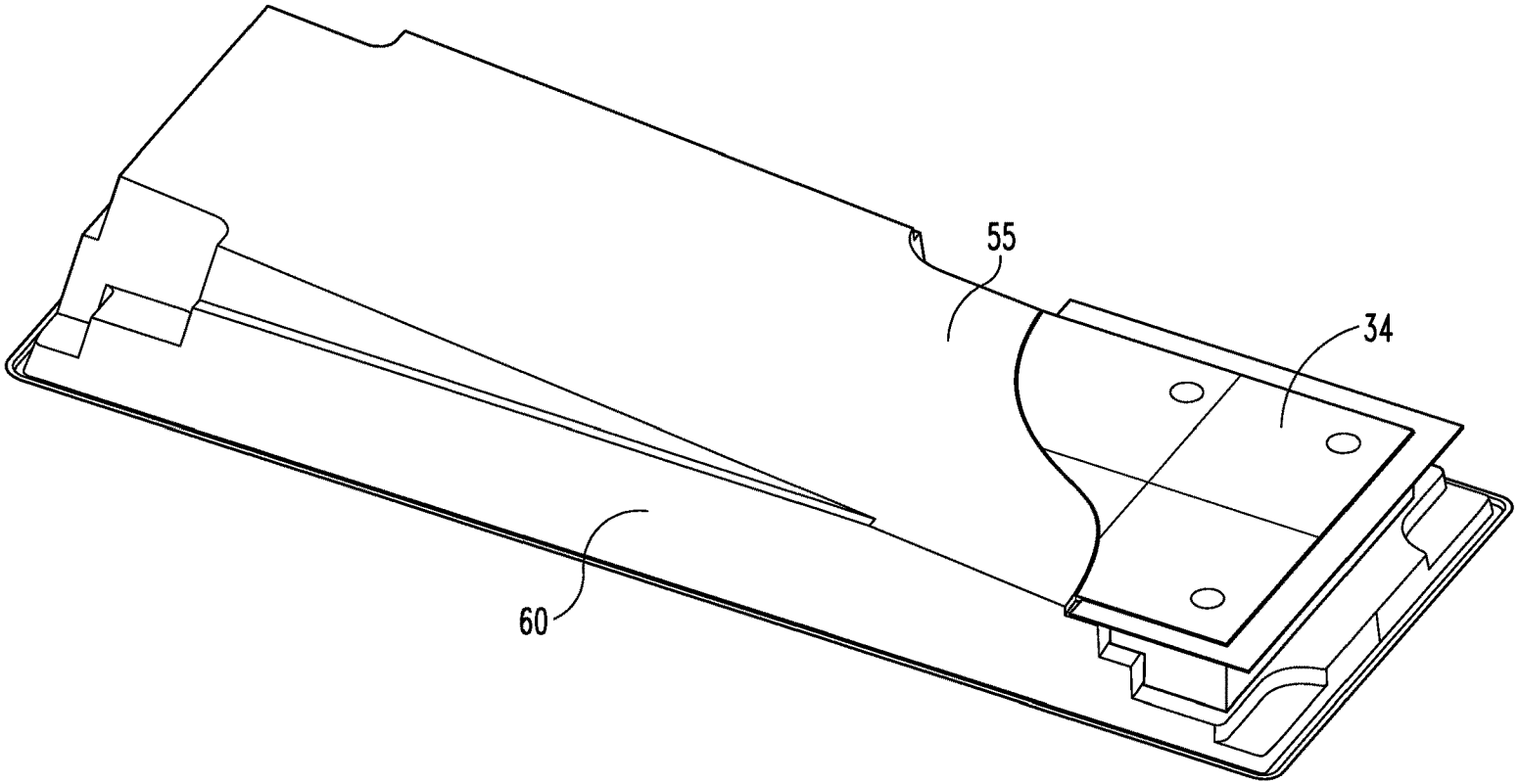
FIG. 4 is a bottom perspective view of the pool assembly of FIG. 2 with the support structure engaged to the fiberglass pool body.
Figure 5:
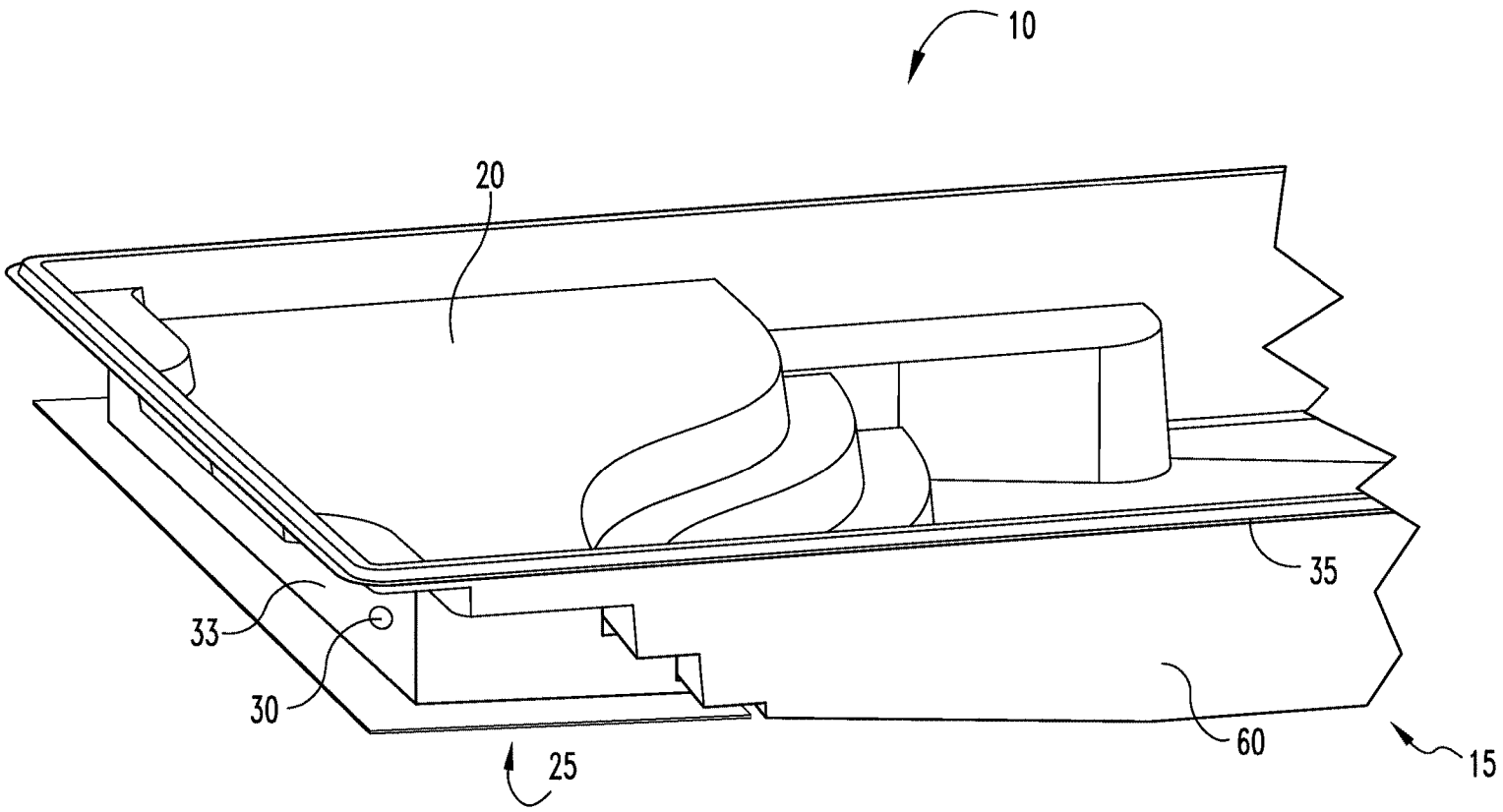
FIG. 5 is a top perspective view of the pool assembly of FIG. 3 with the support structure engaged to the fiberglass pool body.
Figure 6:
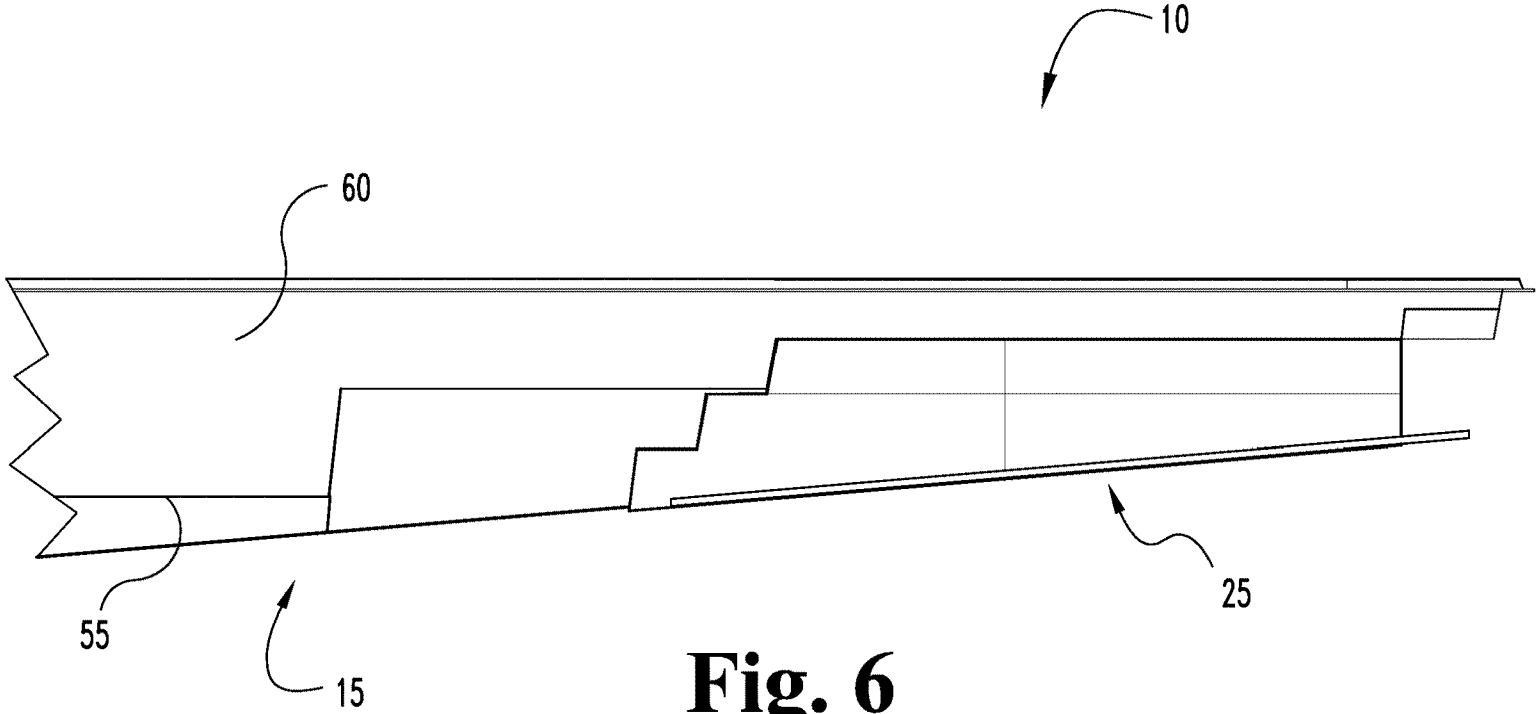
FIG. 6 is a side elevation view of the pool assembly of FIG. 1 with the support structure engaged to the fiberglass pool body.
Figure 7:
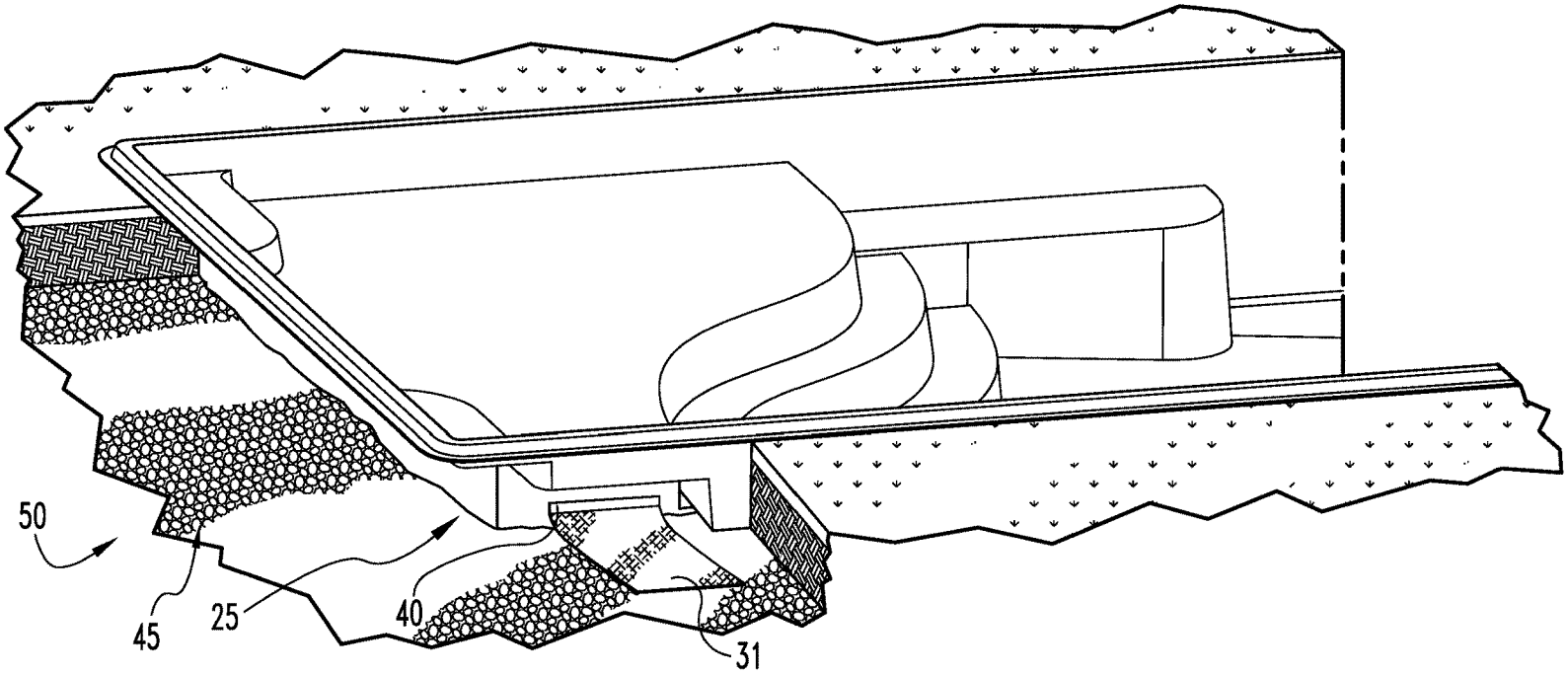
FIG. 7 is a top perspective partial cutaway view of the pool assembly of FIG. 3 with the support structure engaged to the fiberglass pool body and emplaced in the ground.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The present novel technology relates to an assembly 10 for assisting in the mounting or installing a fiberglass or like preformed swimming pool body 15 having a protruding or extending shallow tanning ledge or deck portion 20 into a freshly dug excavation, and includes a support structure 25 fixedly connectible to the deck portion 20 for providing support for the deck portion 20 when the pool body 15 is installed in an excavation. The support structure 25 is typically a generally hollow housing or body 25 with one or more apertures 30 formed therethrough and is typically made of a lightweight structural material, such as fiberglass, aluminum, or the like. Typically, at least one, and more typically a plurality, flexible, tough sheet segment 31 is securely bonded to one or more exterior sidewalls 33 of the support structure 25 for extension therefrom. The support structure further typically includes a floor member 34 from which the sidewall/sidewalls 33 extend to define an open-topped enclosure. The pool tanning ledge or deck 20, when connected to the support structure 25, defines an enclosing top wall or ceiling portion 20.

Typically, an anchor member 31, such as one or more flexible sheets of geotextile, fiberglass, or like material and/or a rigid anchoring flange formed from fiberglass, aluminum, or like material, or the like, is operationally connected to the support structure 25 floor member 34 and/or at one or more exterior sidewalls 33. In the case of flexible sheet members 31, the sheets 31 are typically positioned at one or more different elevations (distances from the top lip 35 of the pool body 15 when oriented for positioning in the ground) and are spaced around the support structure perimeter. After the pool body 15 is positioned into the excavation, the excavation around the pool body 15 is backfilled (typically with gravel) to cover the anchor member 31 to thus provide a downward force to counter any buoyancy forces that may be generated by groundwater. If flexible sheets 31 are buried in backfill, the weight of the soil pressing on the extended sheets 31, as securely bonded to the fiberglass outer walls 31, is sufficient to generate an outward and downward force on the walls 31 to at least partially counter the upwardly directed buoyancy force produced by groundwater around the pool body 15, which is non-negligible when the pool body is underfilled with water. Optionally, the backfill may be compacted manually or with a mechanical compactor at one or more points during the backfilling process.

The anchor member(s) 31 is typically securely bonded to an exterior sidewall 33 and/or floor member 34, such as by an additional application of a fiberglass fusion bonds or volumes 40, by an adhesive material bond 40, or the like.

In operation, the support structure 25 is typically installed when the pool is produced or as an after-market upgrade, or may even be formed as a unitary part of the fiberglass pool body 15 during manufacture. Typically, the support structure 25 is adhered to the pool body 15 under the tanning deck 20 by fiberglass fusion bonds 40 or like adhesive materials 40 prior to the pool body 15 being emplaced in an excavation, so that the pool body may be level and feel rigid and solidly supported when a person walks onto the tanning ledge 20. Typically, the pool body has a bottom member or floor 55 and at least one pool wall 60 extending from the floor member 55 to the top lip 35; the pool body bottom member 55 and the support structure floor member typically extend equidistantly from the top lip 35 to make excavation simpler. However, the excavation may be formed to approximate the shape of the pool body 15, including the shallow tanning ledge 20, and in such cases the bottom portions 34, 55 are positioned at different distances from the top lip 35 (or, in other words, the support structure 25 is shorter). The support structure 25 thus reduces the amount of backfill material necessary to install the pool body 15 while providing structural support beneath the tanning ledge 20 to support the weight of water and/or swimmers. The support structure 25 also allows for installers to have better access to drill holes for water jets and/or bubblers.

Once installed, the apertures 30 allow for water supplied during installation and ambient groundwater to fill the hollow support structure 25 to further weigh down the support structure 25, countering the upwardly-directed buoyancy forces urging the pool body out of the ground. Groundwater freely flows into and out of the apertures 30 such that the effects of stagnant water and buoyancy are both reduced or eliminated.

As the anchor member(s) 31 extend(s) from the support structure body 25 and into the excavation into which the pool body 15 has been placed, backfill is poured to partially fill the excavation. The outwardly extending anchor member (s) 31 extend(s) is covered by backfill and remain(s) anchored in place. The weight of the backfill material on the anchor member(s) 31 generates a frictional anchoring force thereupon that resists movement of the anchor member(s) 31, thus creating a downward or pulling force on the exterior bottom floor member 34 and/or the sidewalls 33 to oppose any pushing force generated by buoyance thereagainst.

In some embodiments, an access point or hatch 41 is formed through the support structure 25 (typically through a sidewall 33) to allow a workman, such as a plumber, entry thereinto.

This process may define a method of stabilizing the tanning deck 20 of a preformed swimming pool body 15, including bonding a support structure 20 to the pool body 15 beneath or adjacent the tanning deck portion 20, integrating an anchor member 31 to an exterior surface 33, 34 of a preformed support structure 25, and then covering the extended anchor member 31 with volume of backfill material 45. If the anchor member 31 is a sheet of geotextile or like material, the extended sheet 31 is laid out upon a first volume of backfill surface 50 and then buries under a second volume of backfill material 45. The method is continued by next bonding a second anchor sheet 31 to an exterior surface or sidewall 33, extending the second anchor sheet 31 over the second volume of backfill material 45, laying the extended second anchor sheet 31 on a second volume of backfill surface 50 and finally burying the extended second anchor sheet 31 under a third volume of backfill material 45. The anchor sheet 31 is typically a porous geotextile material. Typically, the first and subsequent anchor sheets 31 each define a plurality of geotextile segments arrayed in a row around the preformed support structure 20 and positioned substantially equidistantly from a top edge 35. The backfill material 45 is typically selected from the group comprising soil, sand, gravel and combinations thereof. Once the anchor sheets 31 are so emplaced, backfilling is completed and water, sand, or the like is allowed to fill the support structure 20.

The pool body 15 may be of any convenient shape, including rectangular, generally rectangular, kidney shaped, round, oval, or the like. The sheets 31 may extend from opposing sidewalls 33, adjacent sidewalls 33, from random positions, or the like.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A swimming pool assembly, comprising:

a swimming pool body defining a pool top edge and an oppositely disposed bottom pool floor member connected by at least one pool wall and having a shallow deck portion;

a support structure for providing support to the deck portion operationally connected to the deck portion and extending away from the pool top edge, wherein the support structure further comprises:

a support structure floor member;

at least one support structure wall member extending therefrom and connected to the shallow deck portion to define an enclosure; and at least one fluid access aperture formed through the support structure wall member to provide fluidic communication with the enclosure; and an anchor member operationally connected to and extending from the support structure;

wherein the anchor member is at least one geotextile sheet.

2. A kit for modifying a preformed swimming pool having a tanning ledge, comprising:

a support structure enclosure for providing connection to the tanning ledge for providing support to the tanning ledge and having at least one wall portion extending from a floor portion to define an open-topped enclosure; and at least one anchor member connectible to the support structure; and adhesive for bonding the support structure to the tanning ledge.

3. The kit of claim 2 wherein the support structure is fiberglass and wherein the adhesive is fiberglass bonding agent.

4. The kit of claim 2 wherein the anchor member is at least one flexible geotextile sheet for burying in backfill to provide a counter-buoyancy force to the support structure.

5. The kit of claim 2 wherein the anchor member is a rigid flange connectible to the support structure.

6. A method of stabilizing a preformed swimming pool body having a tanning ledge, comprising:

a) engaging a support enclosure below a tanning ledge of a preformed swimming pool body to define a swimming pool assembly;

b) positioning the swimming pool assembly in an excavation;

c) supporting the tanning ledge with the support structure in the excavation;

d) backfilling around the swimming pool body and the support structure; and wherein the support structure has at least one aperture for fluidic communication therethrough.

7. The method of claim 6 and further comprising:

e) filling the support structure with water.

8. The method of claim 6, and further comprising:

f) before d), extending geotextile sheets away from the support structure; and g) burying extended geotextile sheets in backfill to provide a counter-buoyancy force to the support structure.

9. The method of claim 6 and further comprising:

h) entering the support enclosure through a hatch.

10. The method of claim 6, and further comprising:

i) before d), extending a rigid flange away from the support structure; and g) burying the extended rigid flange in backfill to provide a counter-buoyancy force to the support structure.

* * * * *